United States Patent [19]

Tong

[11] 4,030,059

[45] June 14, 1977

[54] FUSE

[76] Inventor: George Kwo Kiun Tong, 39, MacDonnell Road, Hong Kong

[22] Filed: June 9, 1975

[21] Appl. No.: 584,716

[52] U.S. Cl. ..... 337/262; 337/255; 337/263

[51] Int. Cl.[2] ..... H01H 85/24

[58] Field of Search ..... 337/255, 260, 262, 263, 337/265, 268, 270, 271

[56] References Cited

UNITED STATES PATENTS

| | | | |
|---|---|---|---|
| 1,606,143 | 11/1926 | Butterfield | 337/255 X |
| 2,900,475 | 8/1959 | Rosso | 337/262 |

FOREIGN PATENTS OR APPLICATIONS

| | | | |
|---|---|---|---|
| 94,586 | 4/1923 | Austria | 337/255 |

*Primary Examiner*—J D Miller
*Assistant Examiner*—Fred E. Bell
*Attorney, Agent, or Firm*—Ralph W. Kalish

[57] ABSTRACT

The present invention constitutes a fuse which comprises a glass envelope having a solid base portion; there being a lead-in conductor of Dumet metal projecting through the base and into the interior of the envelope. The inner end of the lead-in conductor is rigidly engaged to the inner end portion of a filament. The other end of the filament extends into the solid base and is therein fixedly joined to the inner end of a lead-out conductor formed of Dumet metal. The said conductors in their outer ends are suitably connected to terminals or posts in a base plug which supports the glass envelope.

7 Claims, 2 Drawing Figures

FUSE

BACKGROUND AND SUMMARY OF THE INVENTION

The present invention relates in general to electrical circuit protective devices and, more particularly, to a fuse.

It is an object of the present invention to provide a fuse which is suitable for rendition in relatively small or miniature form so as to be useful for protection in circuits of varying types which heretofore have not been provided with such devices.

It is another object of the present invention to provide a fuse of the type stated which, among other uses, has proven extremely effective with circuits involving Christmas tree lights so as to accord the same protection against inadvertent overload; an expedient unavailable to the present time.

It is a still further object of the present invention to provide a fuse for the purpose stated which comprises lead-in and lead-out conductors of an alloy which is distinct from the composition of the filament engaged therebetween and with the joint between the lead-out conductor and the filament being embedded within a solid mass for preventing accidental or unauthorized rupture thereof.

It is another object of the present invention to provide a fuse of the character stated wherein the use of costly platinum conductors is obviated, and thereby conducing to the economic production of such fuse.

It is another object of the present invention to provide a fuse of the character stated which is amenable to high volume production; which is extremely versatile in usage, having a multiplicity of applications; and which is reliable and durable in usage.

DESCRIPTION OF THE PREFERRED EMBODIMENT

Figure 1:
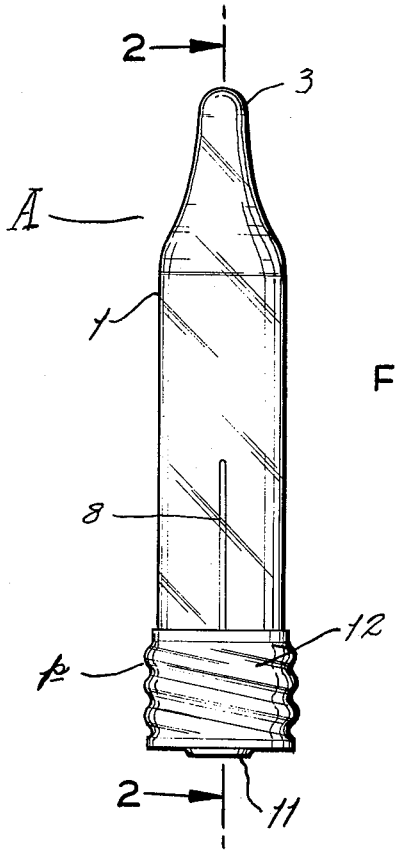
FIG. 1 is an elevational view of a fuse constructed in accordance with and embodying the present invention.
Figure 2:
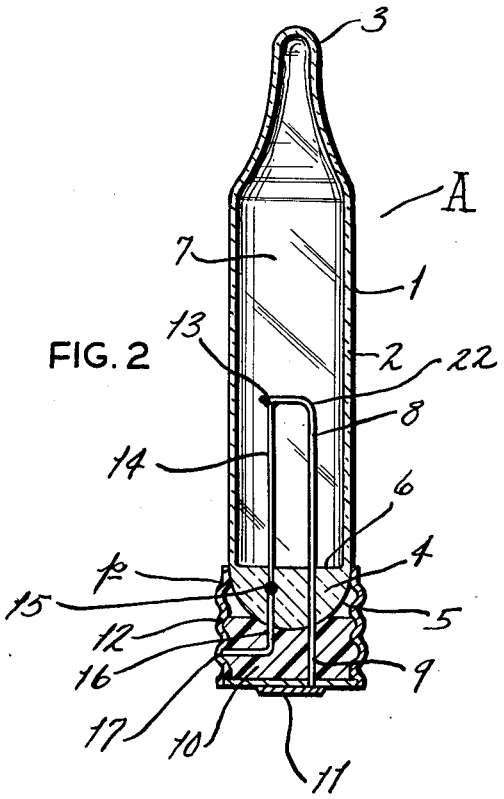
FIG. 2 is a transverse sectional view taken on the line 2—2 of FIG. 1.

Referring now by reference characters to the drawings which illustrate the preferred embodiment of the present invention, A generally designates a fuse which may be of generally miniature character and particularly adapted for utilization with the customary, serially connected lights for decorating Christmas trees and the like. Fuse A comprises a relatively thin walled, glass envelope or casing 1 of elongated, basically cylindrical form, having a continuous side wall 2 which in its upper portion draws to a converging sealed end 3. Envelope 1 in its lower portion is integral with a solid glass base 4, the lower end face of which may be rounded, as at 5. Base 4 is provided with a generally flat upper face 6 which, together with the adjacent side wall 2, and upper end 3, defines an enclosed chamber 7 which is preferably exhausted or evacuated in accordance with current practice. Extending through solid base 4 for projection of its inner end portion 8 within chamber 7 is a lead-in conductor 9 constituted of Dumet metal, being in this instance relatively fine wire, which conductor at its outer end, below base 4 projects through a dielectric mass 10 as formed of plastic or other suitable material for connection to the usual end terminal 11;

there being a conductive corrugated sleeve 12 embracing said mass 10 and envelope base 4 to complete the formation of a plug, indicated generally *p*, for engagement within the customary socket (not shown). The term "Dumet" is accepted as identifying an alloy which is substantially approximately 42 percent nickel and 58 percent iron, but with the recognition that there may often be less or about 1 percent of a combination of various metallic components, such as silicon, carbon, magnesium, etc. Dumet metal as used as a conductor of electrical current, as in the present invention, is copper coated or clad for normally inhibiting any so-called out-gassing action. Dumet metal is a low expansion alloy having substantially the same thermal expansion as glass so that with its peculiar rate of contraction and expansion under heat, the suitability of same for use in a fuse is apparent.

The inner end of conductor 9, within substantially the central zone of chamber 7, is bent, as at 22, for fixing of its proximate end extremity, as by a joint 13 developed through welding or otherwise fusing, to the inner end portion of a filament 14 constituted desirably of tungsten. Thus, filament 14 is maintained in axially parallel spaced-apart relationship with respect to the major portion of conductor 9 within chamber 7. The lower end of filament 14 projects into envelope solid base 4 and therein, at its extremity, is welded or otherwise fused, with the development of a joint 15 to the inner end of a lead-out conductor 16 also constituted of Dumet metal and being a relatively fine wire; which conductor 16 progresses outwardly through base 4 into dielectric mass 10 for ultimate connection to sleeve 12, as at 17, of plug *p*. It will thus be seen that joint 15, or the point of rigid connection between filament 14 and lead-out conductor 16, is fully embedded within the solid glass body constituting base 4, and hence steadfastly maintained thereby against rupture, parting, or the like.

Fuse A may thus be engaged within a circuit for providing a ready visual indication of the condition thereof and with the length and diameter of filament 14 being so selected, in accordance with well known techniques, that when the current flow exceeds a specified amperage, the same will melt by reason of its failure to lose through radiation sufficient of the resistance heat to maintain its temperature below melting. Manifestly, upon melting the circuit will thus be opened. Fuses of the present invention, as indicated above, are especially suitable for rendition in miniature form, such as, for example, comprehending an envelope of approximately 1 inch from base to upper end and with a diameter in the order of less than ¼ inch. Fuses produced in accordance with the invention herein disclosed have been tested at currents of 200 amperes at a voltage of 125 without breakage of the envelope and without ignition of any flammable material, such as cotton, surrounding the envelope. Conductors 9 and 16 being of Dumet metal have, as indicated, excellent thermal expansion properties relative to glass so that such conductors may replace those heretofore constituted of costly platinum. Solid base 4 so retains the fully embedded joint 15 as to assure against any untoward or accidental disengagement between filament 14 and conductor 16. Furthermore, said conductors 9, 16 constitute excellent "seal-in" wires which with the copper coating inhibits the emission of oxygen or other gases into chamber 7 which would have the tendency of reducing the effective life of filament 14.

Having described my invention what I claim and desire to obtain by Letters Patent is:

1. A fuse comprising means defining a transparent casing having a side wall, a closed upper end, and a base, a first conductor having inner and outer ends extending through said base with its inner end within said casing and its outer end exteriorly of said base, a second conductor having inner and outer ends with its inner end embedded within said base and its outer end exteriorly of said base, and a filament having an inner end engaged to the inner end portion of said first conductor and an opposite end fixed to said second conductor inner end within said base.

2. A fuse as defined in claim 1 and further characterized by said casing base having a thickness substantially greater than the thickness of the casing side wall.

3. A fuse as defined in claim 2 and further characterized by said casing being formed of glass and being evacuated.

4. A fuse as defined in claim 1 and further characterized by said first and second conductors being of Dumet metal.

5. A fuse as defined in claim 4 and further characterized by said filament being of tungsten.

6. A fuse as defined in claim 1 and further characterized by said casing base having a thickness substantially greater than that of the thickness of the casing side wall, the inner end of said second conductor and the outer end of said filament being joined together in fully embedded condition within said base.

7. A fuse as defined in claim 6 and further characterized by said first and second conductors being of Dumet metal and said filament being of tungsten.

* * * * *

UNITED STATES PATENT OFFICE

CERTIFICATE OF CORRECTION

PATENT NO. : 4,030,059

DATED : June 14, 1977

INVENTOR(S) : George Kwo Kiun Tong

It is certified that error appears in the above-identified patent and that said Letters Patent are hereby corrected as shown below:

In the Heading, after [76] and before [22] insert
--- [73] Assignee Tung Ming Electrical Co. Ltd.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*